US006959522B2

(12) United States Patent
Johnston et al.

(10) Patent No.: US 6,959,522 B2
(45) Date of Patent: Nov. 1, 2005

(54) SYSTEM FOR FILLING CONTAINERS

(75) Inventors: Lloyd P. Johnston, Belmont, MA (US); Kevin Stapleton, Seattle, WA (US); Ernest Penachio, Cambridge, MA (US); Mark Wolff, Somerville, MA (US)

(73) Assignee: Advanced Inhalation Research, Inc., Cambridge, MA (US)

( * ) Notice: Subject to any disclaimer, the term of this patent is extended or adjusted under 35 U.S.C. 154(b) by 0 days.

(21) Appl. No.: 10/782,965

(22) Filed: Feb. 23, 2004

(65) Prior Publication Data

US 2004/0168400 A1 Sep. 2, 2004

Related U.S. Application Data

(60) Continuation of application No. 10/052,632, filed on Jan. 23, 2002, now Pat. No. 6,715,259, which is a division of application No. 09/642,666, filed on Aug. 22, 2000, now Pat. No. 6,357,490.

(51) Int. Cl.[7] ..... B65B 43/40

(52) U.S. Cl. ..... 53/169; 53/267; 53/560; 53/276

(58) Field of Search ..... 141/2, 4, 8, 65, 141/363–365, 237, 238, 242, 246, 286, 67, 71, 81; 53/281, 282, 560, 276, 169, 205, 485, 269, 319, 267, 272, 253, 381.4, 390, 391

(56) References Cited

U.S. PATENT DOCUMENTS

| | | | |
|---|---|---|---|
| 634,837 | A | 10/1899 | Seely |
| 1,037,974 | A | 9/1912 | Paraskovich |
| 3,192,964 | A | 7/1965 | Vogt |
| 3,195,586 | A | 7/1965 | Vogt |
| 3,260,285 | A | 7/1966 | Vogt |
| 3,788,368 | A | 1/1974 | Geng et al. |
| 3,847,191 | A | 11/1974 | Aronson |
| 3,874,431 | A | 4/1975 | Aronson |
| 4,001,211 | A | 1/1977 | Sarkar |
| 4,283,901 | A | 8/1981 | Schieser et al. |
| 4,297,828 | A | 11/1981 | Krieger et al. |
| 4,341,244 | A | 7/1982 | Facchini |
| 4,343,130 | A | 8/1982 | Facchini |
| 4,501,307 | A | 2/1985 | Moser et al. |
| 4,640,322 | A | 2/1987 | Ballester |
| 4,640,448 | A | 2/1987 | Trechsel |
| 4,671,430 | A | 6/1987 | Dinius |
| 4,751,948 | A | 6/1988 | Hertig et al. |
| 4,864,876 | A | 9/1989 | Botzolakis et al. |
| 4,884,602 | A | 12/1989 | Yamamoto et al. |
| 4,949,766 | A | 8/1990 | Coatsworth |
| 5,002,103 | A | 3/1991 | Marescalchi |
| 5,209,044 | A | 5/1993 | D'Addario et al. |

(Continued)

FOREIGN PATENT DOCUMENTS

| | | |
|---|---|---|
| GB | 1420364 | 1/1976 |
| WO | WO-95/11658 | 5/1995 |
| WO | WO-97/41031 | 11/1997 |

*Primary Examiner*—John Paradiso
(74) *Attorney, Agent, or Firm*—Andrea G. Reister; Covington & Burling

(57) ABSTRACT

Method and apparatus for providing a precisely controlled amount of dry material to a container. In one embodiment, a system is provided for automated container filling. The system includes a container handling mechanism that includes a container block defining a container receptacle, and a cap carrier defining a cap receptacle. The system also includes a dosing portion having a dosing plate defining a dosing hole. The dosing plate is movable between two positions so that when the dosing plate is in the first position the dosing hole is positioned to receive a dose of powder. When the dosing plate is in the second position, the dosing hole is positioned to dispense the dose of powder into the container receptacle.

17 Claims, 8 Drawing Sheets

U.S. PATENT DOCUMENTS

| | | | |
|---|---|---|---|
| 5,339,871 | A | 8/1994 | Collins et al. |
| 5,429,699 | A | 7/1995 | Abrams et al. |
| 5,447,183 | A | 9/1995 | Derby |
| 5,503,144 | A | 4/1996 | Bacon |
| 5,549,144 | A | 8/1996 | Dworak et al. |
| 5,743,069 | A | 4/1998 | Ansaloni |
| 5,775,389 | A | 7/1998 | Griffin |
| 5,787,881 | A | 8/1998 | Chawla |
| 5,809,744 | A | 9/1998 | Villines et al. |
| 5,826,633 | A | 10/1998 | Parks et al. |
| 5,855,233 | A | 1/1999 | Bolelli |
| 6,267,155 | B1 | 7/2001 | Parks et al. |
| 6,341,472 | B1 | 1/2002 | Schroeder |
| 6,581,650 | B2 | 6/2003 | Parks et al. |

SYSTEM FOR FILLING CONTAINERS

CONTINUING DATA

This application is a continuation of U.S. application Ser. No. 10/052,632 filed Jan. 23, 2003, now U.S. Pat. No. 6,715,259; which is a Divisional of U.S. application Ser. No. 09/642,666 filed Aug. 22, 2000, now U.S. Pat. No. 6,357,490.

BACKGROUND OF THE INVENTION

1. Field of the Invention

The present invention relates generally to a system, method and apparatus for filling a container. More specifically, the present invention relates to a system, method and apparatus for vacuum-assisted filling of medicinal capsules with a precise dosage of dry powder pharmaceutical.

2. Related Art

In medicine, it is often desirable to administer various forms of medication to patients. A well known method of introducing medication into the human body is the oral ingestion of capsules. In another method, a patient may inhale certain medications through the nose or mouth. Inhalable medications come in numerous forms, including solids that are typically in the form of fine, dry powders. Specialized devices, such as inhalers, are typically provided to assist the patient in directing these fine powder medications through an airway and eventually into the lower respiratory tract. Various means for loading an inhaler with a proper dose of medication prior to use are known, including the use of capsules. For example, U.S. Pat. No. 5,787,881 discloses an inhaler that is used with encapsulated dry powder medicaments. Such devices require that capsules containing precise doses of medicament be available. The capsules are punctured and then inserted into the inhaler for inhalation of the medicament contained therein.

Countless other applications as well rely upon containers containing a specified amount of any of a number of materials. Many devices are known for filling such containers. However, each of these devices suffers certain drawbacks. U.S. Pat. No. 5,743,069, for example, discloses a metering device for medical applications. In this device, metering members are used to mechanically meter dosages of pharmaceutical through a plurality of holes, and eventually into a plurality of capsules. However, such mechanical metering devices, which rely only on mechanical members and gravity to apportion a particular dose of powder from a larger supply thereof, may lead to inaccurate doses. Such inaccuracies can result from, among other things, air pockets or clumps of powder in the supply. In addition, medical applications relating to inhalable medicaments may involve the handling of very fine, low-density powders. It has been found that these powders are difficult to handle due to their tendency to aerosolize, or become airborne, at the slightest provocation. Thus, a device for the metering of such powders must be designed with this quality in mind.

U.S. Pat. No. 5,826,633 discloses a powder filling apparatus for transferring an amount of powder to a receptacle. While the device addresses a problem of conglomerated powder through the use of a fluidizing means, the device is rather complex. Included are a variety of mechanical parts having relatively complicated interactions, and two motors requiring an external power supply. In addition, sources of vacuum and/or pressure are required.

Other devices, such as that disclosed in U.S. Pat. No. 5,809,744, address a problem of preventing aerosolization of fine powders, also through application of a vacuum. However, the device of U.S. Pat. No. 5,809,744 draws a vacuum directly through a container, such as a filter bag, into which a material such as coffee is to be vacuum-packed. Because such a device utilizes a vacuum for packing, it is not readily suitable for metering an accurate amount of a material for delivery to a non-porous container. Such a device cannot fill containers such as medicinal capsules, through which a vacuum is not easily drawn. In addition, medical applications regularly require high accuracy on a far smaller scale of dosage than the disclosed larger-scale device could offer.

Still other devices, such as the material apportioning apparatus disclosed in U.S. Pat. No. 4,671,430 and the powder filler disclosed in U.S. Pat. No. 4,949,766, attempt to overcome the above problem by apportioning material in a different container from that which is intended to eventually contain the apportioned amount. However, such devices fail to provide the simplicity of design and ease of use sought by those in the art.

Other conventional capsule filling machines have other disadvantages. Typically such conventional machines are designed to pack large amounts of powders into capsules, and are not optimal for delicate porous powders. Additionally, such conventional machines require a large volume of powder (e.g., greater than 500 ml) to prime the machine. Consequently, for some protein powders, in excess of $100,000 worth of powder is wasted just to prime the machine to fill one capsule.

Thus, there is a need in the art for an improved method and apparatus for filling containers with a precise dosage of dry powder. Specifically, what is needed is a method and apparatus capable of consistently delivering a precisely metered dose of dry powder medicament to a capsule. Preferably, such a device would further be simple in design and easy to use, through either manual or computer-controlled operation. The device would also be adapted to handle the low-density fine powders often present in medical applications, and to vacuum pack such powders into relatively small and highly accurate doses for delivery to a container, using a small priming volume. The present invention, the description of which is fully set forth below, solves the need in the art for such an improved method and apparatus.

SUMMARY OF THE INVENTION

The present invention relates to a system, method and apparatus for filling containers. In one aspect of the invention, a system for filling containers with powder is provided. The system includes a carousel. Disposed in the carousel is a container handling mechanism that includes a container block defining a container receptacle and a cap carrier defining a cap receptacle. The cap carrier is movable between a first carrier position and a second carrier position. The system further includes, adjacent the carousel, a dosing portion having a dosing plate defining a dosing hole. The dosing plate is movable between a first dosing position and a second dosing position, such that when the dosing plate is in the first dosing position, the dosing hole is positioned to receive a dose of powder. When the dosing plate is in the second dosing position, the dosing hole is positioned to dispense the dose of powder into the container receptacle.

Features and Advantages

One feature of the present invention is that it is well adapted for use with a variety of materials, including the very fine, low-density powders typically found in applications relating to inhalable medicaments.

Another advantageous feature of the present invention is that it is relatively simple in design and easy to use. Therefore, the device can be produced less expensively than more complex devices, and only very limited training is required prior to use.

The present invention also possesses the advantage that it consistently provides a high accuracy dosage of material to a container, as is important to a great number of applications. Further, the present invention requires a very small amount of powder for priming, typically less than 500 mg of powder.

Because the present invention carries the additional advantage that it can be manually operated, it can be readied for a single use in a short period of time. This renders it ideal for a laboratory environment where dosages are often required quickly and in limited quantities.

The present invention also advantageously can be computer-controlled and adapted for use in large-scale commercial filling facilities.

Further features and advantages will become apparent following review of the detailed description set forth below.

BRIEF DESCRIPTION OF THE FIGURES

The present invention is described with reference to the accompanying drawings. In the drawings, like reference numbers indicate identical or functionally similar elements.

DETAILED DESCRIPTION OF THE PREFERRED EMBODIMENTS

Overview

The present invention is an improved method and apparatus for providing a precise amount of powder to a container. As will be described in more detail below, an apparatus of the present invention is a container filling device that is easy to operate and has a relatively simple design. The container filler repeatedly delivers to a container a reliable dose of any of a variety of materials. The apparatus includes a dosing wheel for receiving a container to be filled and a dosing plate for metering an amount of material to be delivered to the container. Metering preferably occurs in the dosing plate under force of a vacuum. Means are provided for ejecting the metered amount into the container.

The methods of the present invention use the container filling apparatus to fill a container with an accurate amount of a material. As will be discussed in greater detail below, a user utilizes the method of the present invention by placing a container in the dosing wheel. The dosing wheel is rotated into a position below a dosing hole that houses the predetermined amount of material that has been metered in a dosing plate. The metered dose is then ejected into the container, which can be removed and used as desired.

Filling Apparatus and Associated Methods and System of the Present Invention An exemplary embodiment of the present invention will now be described. While the above discussion has often related to a method and apparatus for filling a medicinal capsule with a powder medicament, it should be recognized that the present invention is equally applicable to any of a variety of fields in which it is desired to introduce a precise amount of a material to a container. The applicability of the present invention is therefore not limited to the medical field.

Figure 1:
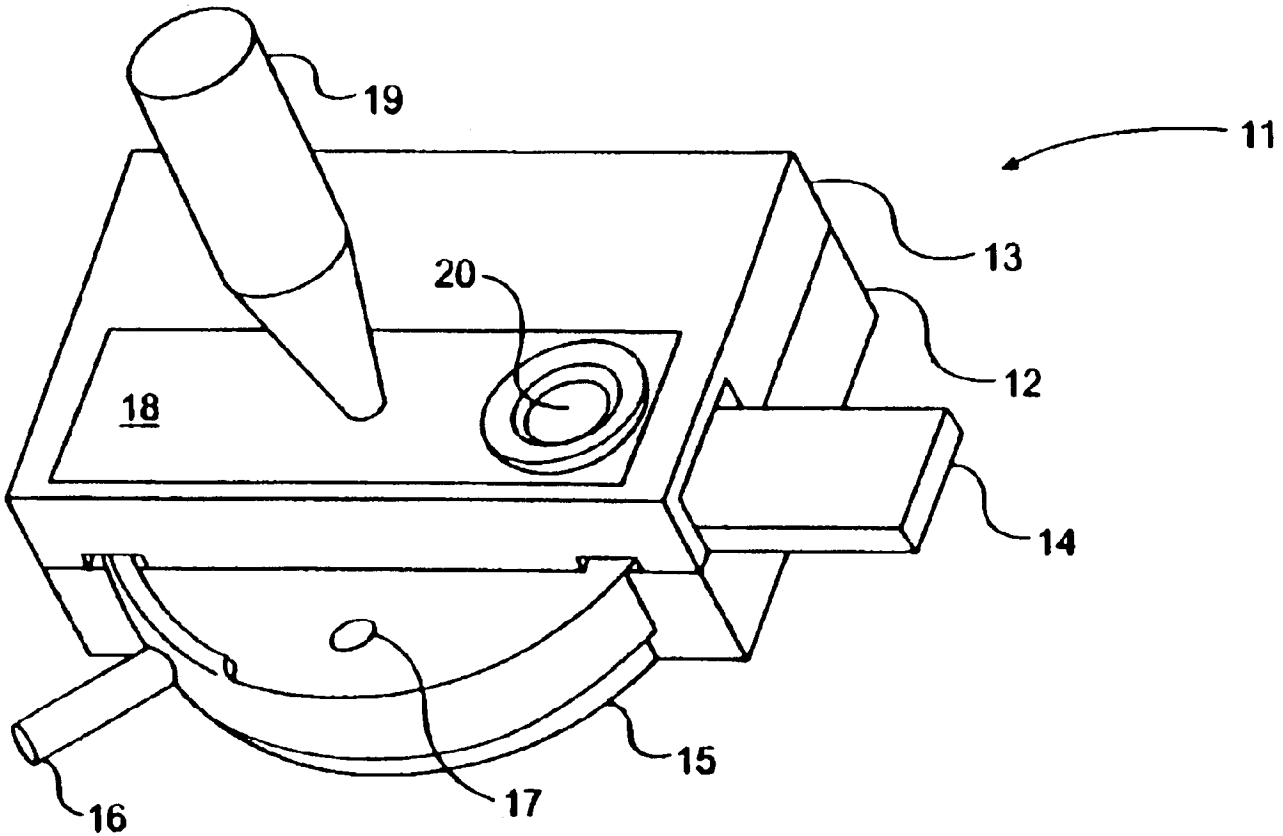
FIG. 1 is a perspective view of one embodiment of a container filling apparatus of the present invention positioned to receive an empty container.
Figure 2:
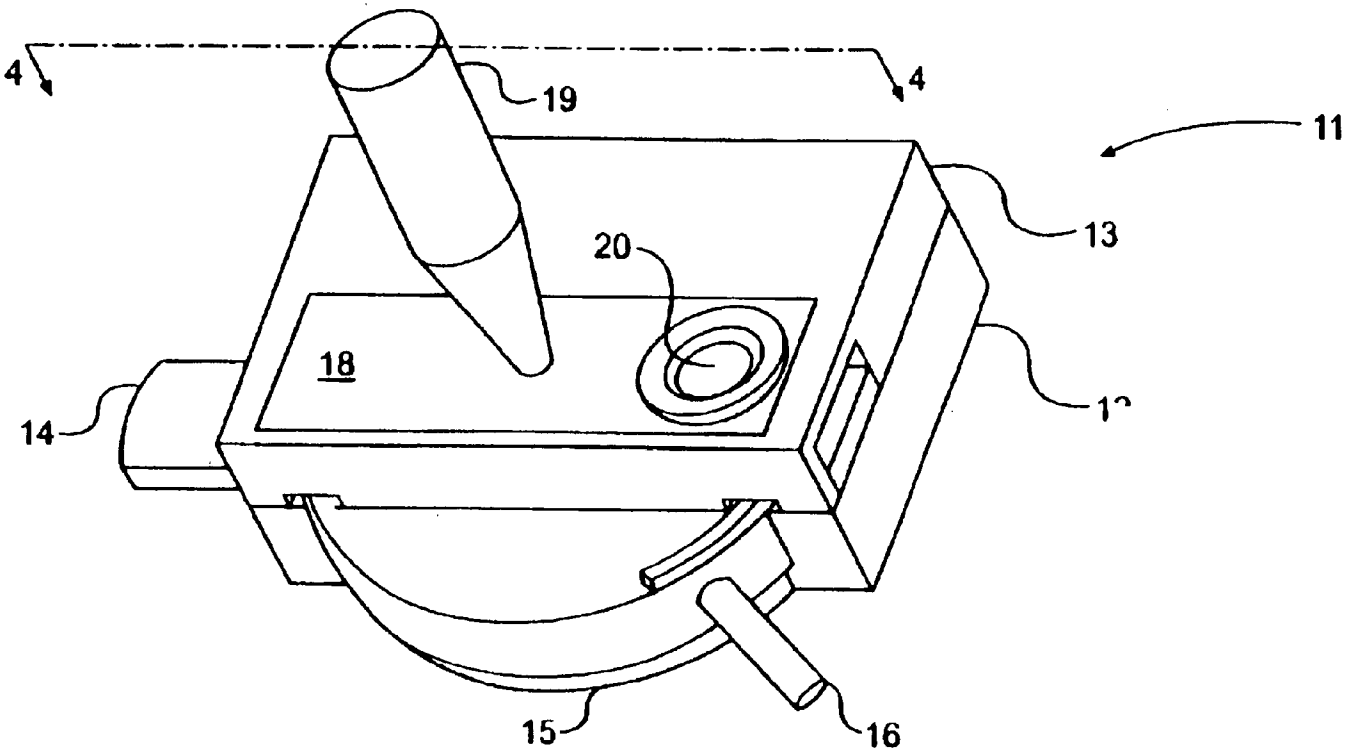
FIG. 2 is a perspective view of one embodiment of a container filling apparatus shown in FIG. 1 positioned to fill a dosing hole.

Referring to FIGS. 1 and 2, an embodiment of a container filling apparatus of the present invention is illustrated as filler 11. The filler 11 comprises a dosing wheel 15 disposed within and movably coupled to a base member 12; a plate guide 13 coupled to the base member 12; a dosing plate 14 disposed within and slidably coupled to the plate guide 13; a receiving plate 18 disposed within the plate guide 13; and an ejector member 20 disposed in the receiving plate 18. The receiving plate 18 has a receiving hole 28 (see FIG. 3) formed therein for receiving a powder hopper 19. The dosing plate 14 has a dosing hole 23 (see FIG. 3) formed therein for receiving a metered amount, that is a 'dose,' of powder or other desired material from the powder hopper 19. The dosing plate 14 is slidable between a filling position, as seen in FIG. 2, and an emptying position, shown in FIG. 1. The filling and emptying positions will be described in more detail below with respect to FIG. 3. The dimensions of the dosing hole 23 will determine the size of the dose of powder received by the dosing hole 23. The size of the dose of powder that will be deposited into a container by the filler 11 will be the size of the dose receivable by the dosing hole 23 or a whole number multiple thereof, since the container may be filled by a single or multiple doses from the dosing hole 23 as desired. When it is desired to deposit an amount of powder differing from the amount receivable by a single or a whole number multiple of doses by the dosing hole 23 of the current dosing plate 14, the dosing plate 14 may be interchanged with another dosing plate having a dosing hole of different dimensions.

Dosing wheel 15 is preferably rotatably coupled to base member 12. It should be readily apparent to one skilled in the art that the present invention is not limited to a dosing wheel of a round or circular shape as depicted in the figures, nor is it limited to a dosing wheel rotatably coupled to the base member. For example, in an alternate embodiment of the present invention, the dosing wheel is configured as a straight (nonround) piece movable in a linear fashion.

The dosing wheel 15 has a container receptacle 17 formed therein for receiving a container to be filled by the filler 11. Preferably with the assistance of a handle 16, the dosing wheel 15 is rotatable between a container loading position, as illustrated in FIG. 1, and a powder receiving position, shown by FIG. 2. As illustrated, the dosing wheel 15 is preferably rotatable independent of the sliding position of the dosing plate 14 and vice versa. In an alternate embodiment of the present invention, the apparatus is configured, through the use of a cam system for example, so that as the dosing wheel 15 is rotated from the container loading position to the powder receiving position and back, the dosing plate 14 automatically slides from the filling position to the emptying position and back. In such an alternate embodiment, the dosing plate 14 is movably coupled to the dosing wheel 15.

In the embodiment shown in FIGS. 1 and 2, the apparatus of the present invention is configured for manual operation for quick and easy use. However, as will be readily apparent to one skilled in the art, operation of the container filler could also be automated through use of a processor, computer, or computer-control system for applications where a greater number of containers need to be filled. An automated embodiment is further discussed below.

Figure 3:
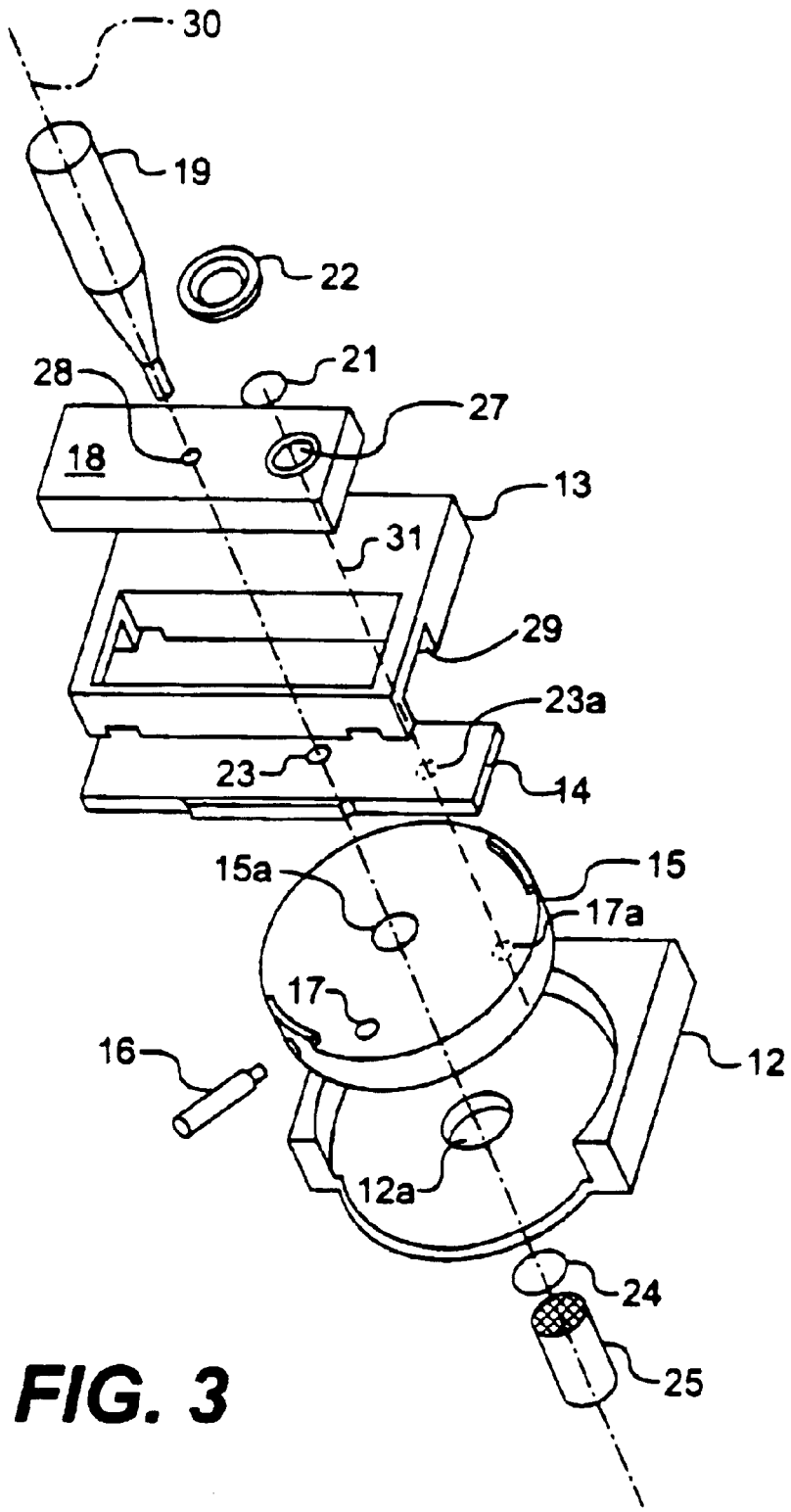
FIG. 3 is an exploded view of one embodiment of a container filling apparatus of the present invention.
Figure 4:
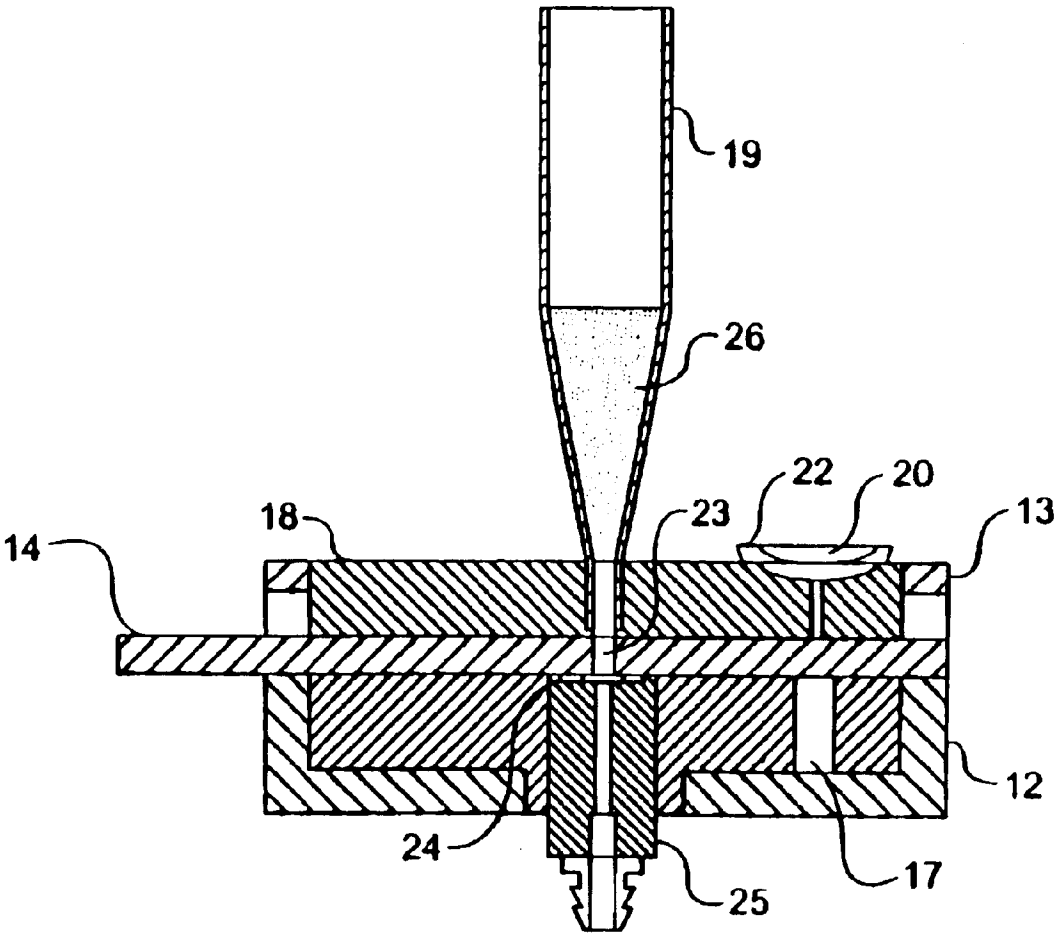
FIG. 4 is a cross-sectional view along line 4—4 of FIG. 2 of one embodiment of a container filling apparatus of the present invention positioned to fill a dosing hole.
Figure 5:
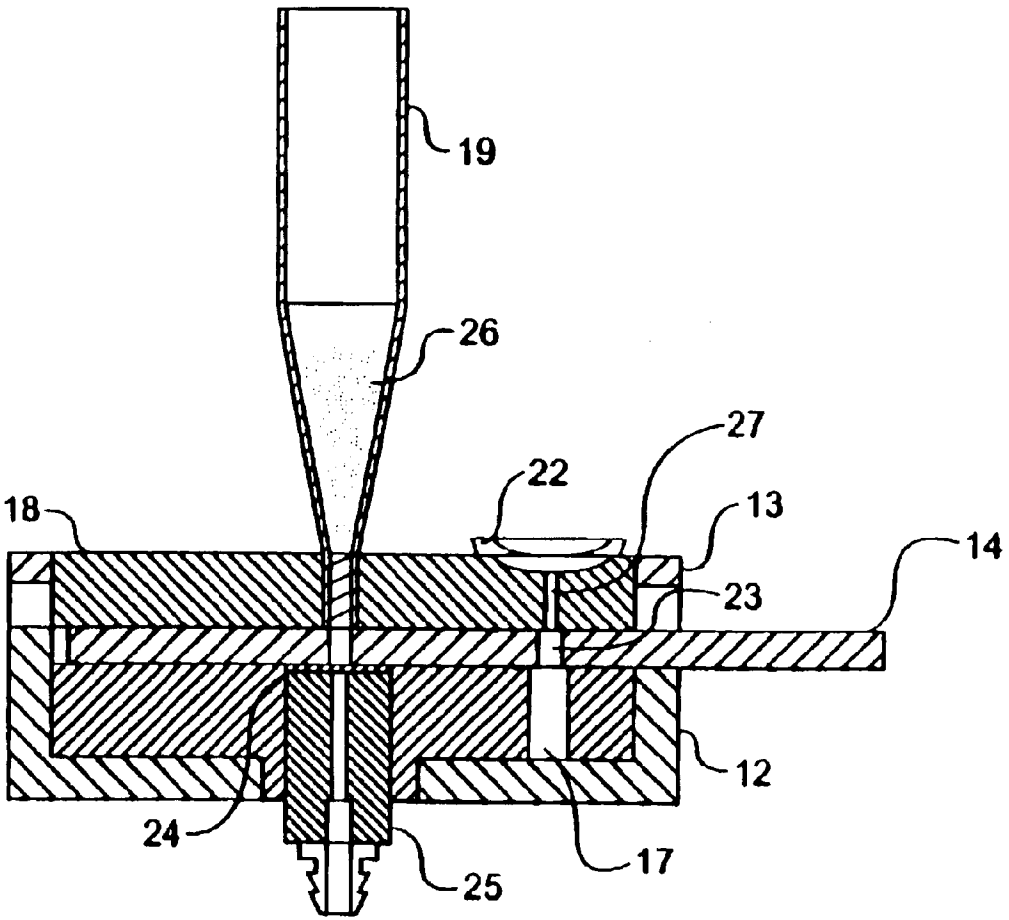
FIG. 5 is a cross-sectional view of one embodiment of a container filling apparatus of the present invention positioned to fill a container.

Referring now to FIGS. 3–5, an internal arrangement of the filler 11 of the present invention may be more readily appreciated. In FIG. 3, the dosing plate 14 is illustrated in the filling position and the dosing wheel 15 is shown in the container loading position. When the dosing plate 14 is in the filling position, the dosing hole 23 will be in registry with the powder hopper 19 and will therefore be in a position to receive a dose of powder from the powder hopper 19, as may also be seen in FIG. 4. Also in registry with the powder hopper 19 and the dosing hole 23 will be the base member central bore 12*a* defined by the base member 12, and the dosing wheel central bore 15*a* defined by the dosing wheel 15, as illustrated by the central bore line 30. Sliding the dosing plate 14 in a channel 29 defined in the plate guide 13 to the emptying position will cause the dosing hole 23 defined in the dosing plate 14 to be in the position illustrated in phantom by hole 23*a*. Rotating the dosing wheel 15 to the powder receiving position will cause the container receptacle 17 defined in the dosing wheel 15 to be in the position illustrated by phantom hole 17*a*. In this position, referring again to FIG. 3, the dosing hole 23 and container receptacle 17 will be in registry. Such registry is shown by the container filling line 31, and can also be seen in FIG. 5. Once in this position, a dose of powder residing in the dosing hole 23 of the dosing plate 14 can be deposited into a container previously loaded into the container receptacle 17.

Details of a filling operation will now be more fully described. When it is desired to add a metered dose of a material to a container, an amount of the material, such as a powder 26 (best seen in FIGS. 4 and 5), greater than a size of the metered dose, is added to the powder hopper 19. As desired, the powder 26 may be added to the powder hopper 19 before, but is preferably added after, the powder hopper 19 is inserted into the receiving hole 28. The dosing plate 14 is moved into the filling position. A dose of the powder 26 may fall into the dosing hole 23 under the force of gravity alone, but is preferably assisted by a vacuum (not shown) to ensure that the powder is well packed in the dosing hole 23, forming a powder slug. The vacuum is connected to a vacuum connection 25, which is provided with a filter 24.

In operation, the vacuum connection 25 and the filter 24 are disposed within the base member central bore 12*a* of the base member 12 and within the dosing wheel central bore 15*a* of the dosing wheel 15. The filter 24 preferably abuts a surface of the dosing plate 14 to form a relatively airtight seal. When the vacuum is operated, the filter 24 allows air to flow through the filter 24 and dosing hole 23 but prevents powder from passing beyond the plane of the surface of the dosing plate 14 against which the filter 24 is abutted. Thus, depending on a particulate size of a powder being used, filter paper of any suitable mesh size may be used. In one embodiment, the use of 0.2 or 0.5 micron paper, for example, is contemplated. When air is drawn through the vacuum, air will also be drawn through the dosing hole 23, the receiving hole 28 and the powder hopper 19. This forcefully draws a dose of the powder 26 from the powder hopper 19 into the dosing hole 23 and against the filter 24 to form the powder slug.

Meanwhile, a container is added to the container receptacle 17 of the dosing wheel 15 while the dosing wheel 15 is in the container loading position. In medical applications, the container will typically be a capsule formed of a material such as gelatin or hydroxypropylmethyl cellulose (HPMC). Once the container has been loaded, the dosing wheel 15 is rotated into the powder receiving position. Following formation of the powder slug in the dosing hole 23, the dosing plate 14 is moved from the filling position to the emptying position, placing the powder slug in position above the container in container receptacle 17. The powder slug may then fall into the container under the force of gravity, or may be assisted through the use of the ejector member 20. The ejector member 20 is disposed in the receiving plate 18, and is in fluid communication with an ejector hole 27 formed therein.

In one embodiment, the ejector member 20 comprises a flexible membrane 22 coupled to the receiving plate 18 by a ring member 21. However, it should be readily apparent to one skilled in the art that other types of ejector members could be used, such as an ejector pin, a valve mechanism for delivering a puff of air, etc. Actuation of the ejector member 20, such as by manual pressure, causes an increase in air pressure in the ejector hole 27, between the flexible membrane 22 and the powder slug, forcing the powder slug from the dosing hole 23 into the container previously placed in the container receptacle 17. The container has now been supplied with a precisely metered dose of the powder 26. One or more additional doses of powder may now be added to the same container by repeating the above steps, or the dosing wheel 15 may be returned to the capsule loading position and the container removed from the container receptacle 17.

Figure 6:
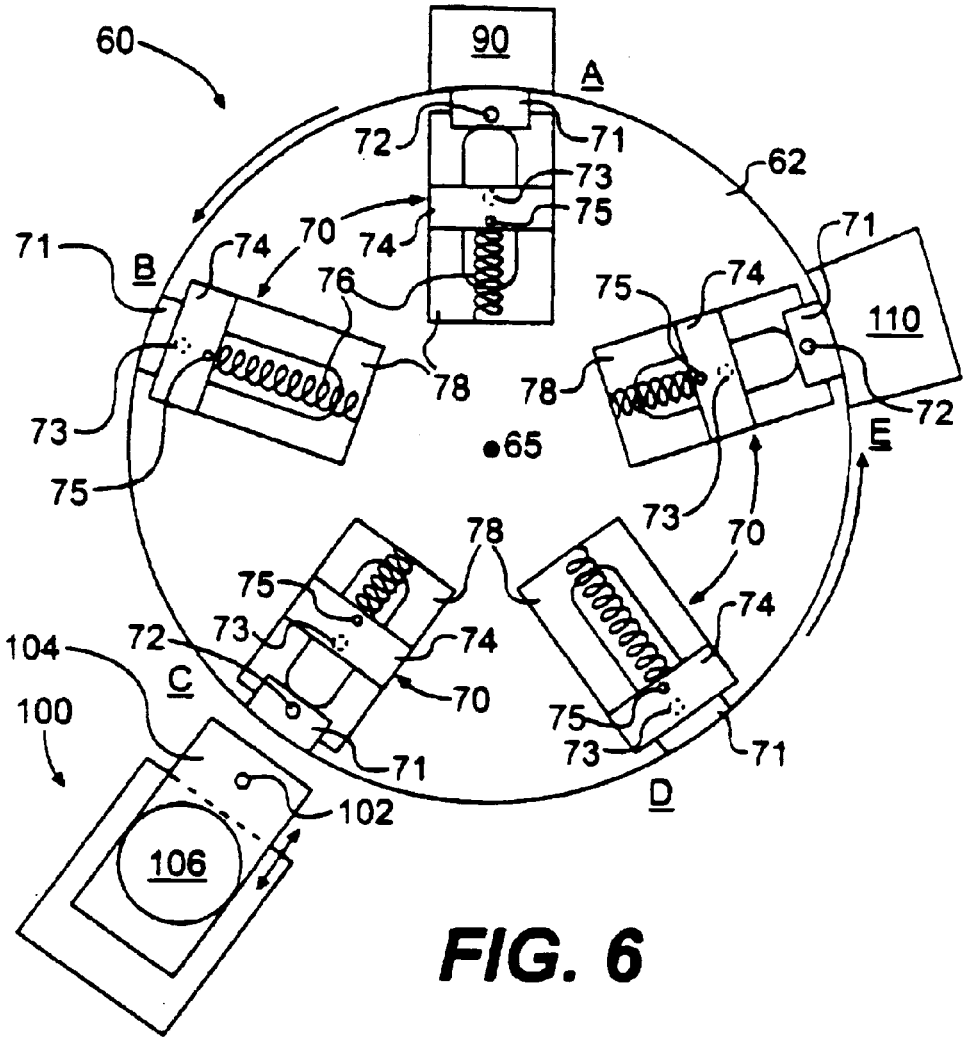
FIG. 6 is an aerial view of one embodiment of a container filling system of the present invention.

Referring next to FIGS. 6–9, an embodiment of an automated container filling system of the present invention will be described. A container filler 60 includes a carousel 62 preferably rotatable about a carousel central bore 65 between 5 carousel positions A, B, C, D and E, as illustrated in FIG. 6. As would be readily apparent to one skilled in the art, varying numbers of positions may be used, and the present invention is not limited to five positions. The carousel 62 has disposed therein a plurality of container handling mechanisms 70. Each container handling mechanism 70 includes a container block 71 having formed therein a container receptacle 72 for receiving one or more containers (not shown) to be filled; a cap receptacle 73 (shown in phantom); a cap carrier 74; and a spring assembly 76. Each cap carrier 74 is slidably disposed in a carrier channel 78. Each cap carrier 74 further includes a vacuum opening 75, as will be discussed in greater detail below. While in this embodiment, the number of container handling mechanisms 70 as illustrated corresponds to the number of carousel positions, the number of container handling mechanisms 70 may be greater or lesser as desired.

Figure 7:
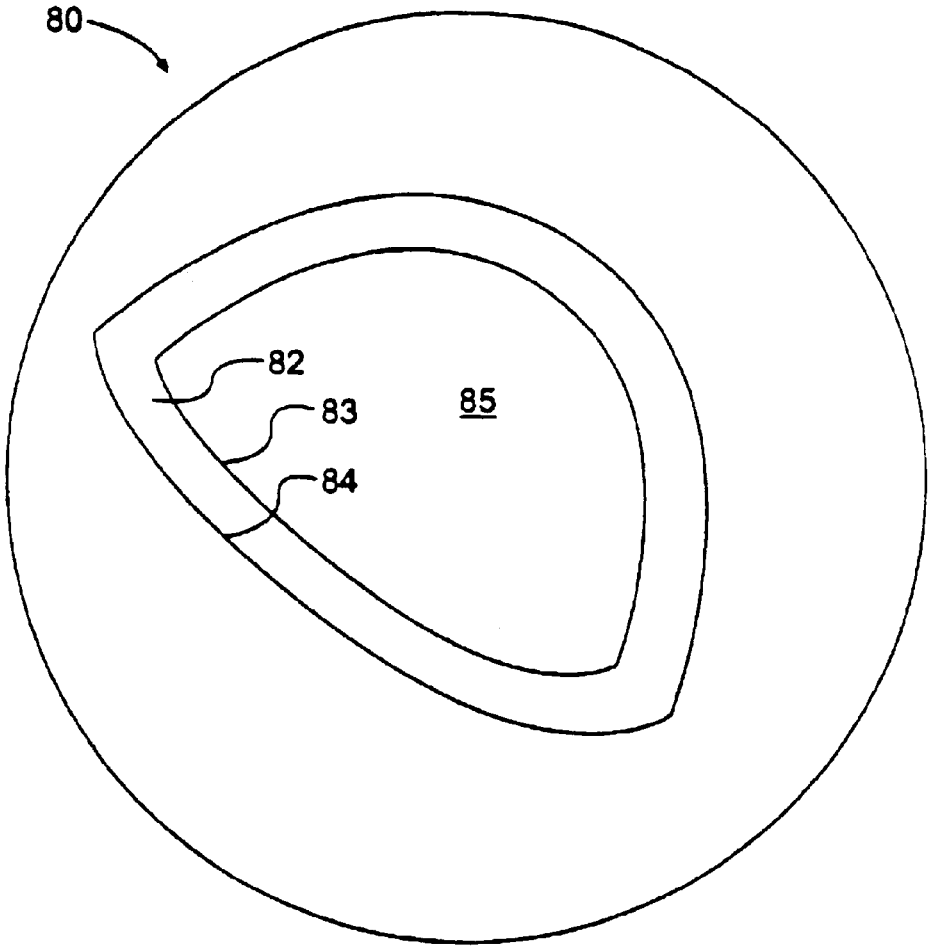
FIG. 7 is an aerial view of one embodiment of a cam disc of a container filling system of the present invention.

Referring next to FIG. 7, a cam disc 80 is illustrated. As will be discussed below with reference to FIG. 9, the cam disc 80 is preferably positioned beneath the carousel 62 for controlling a position of each cap carrier 74 within each carrier channel 78 as the carousel 62 rotates. As is further illustrated in FIGS. 8 and 9, each cap carrier 74 includes a cam bearing 77 that travels about a cam channel 82 formed in the cam disc 80 as the carousel 62 rotates. A cam center 85 of the cam disc 80 preferably corresponds with the central bore 65 of the carousel 62, with each center preferably corresponding to a center axis 105. As will be appreciated by one skilled in the art, forces applied by an inner wall 83 of the cam channel 82 to each cam bearing 77 will translate into lateral movement of each cap carrier 74 within each carrier channel 78 as the carousel 62 rotates with respect to the cam disc 80. An opposing lateral force applied by each spring assembly 76 will keep each cam bearing 77 in contact with the inner wall 83 as the carousel 62 rotates. Alternatively, the spring assemblies 76 may be omitted in reliance instead on the inner and outer walls 83 and 84 of the cam channel 82 to keep each cap carrier 74 in a proper position. It would be readily apparent to one skilled in the art that the cap carrier could alternatively be activated by an electrical, mechanical, or pneumatic activator, and the like. Thus, as the carousel 62 rotates, each cap carrier 74 will reciprocate in each associated carrier channel 78 between a position proximal to each container block 71 and a position distal from each container block 71. Furthermore, while as illustrated, the container blocks 71 and the cap carriers 74 move together on the carousel 62, they may alternatively be designed to move independently. For example, the container blocks 71 may be disposed on a carousel independent of a carousel on which the cap carriers 74 are disposed. In another embodiment, the container blocks may be formed in stationary portions adjacent a carousel housing the cap carriers 74, etc.

Figure 8:
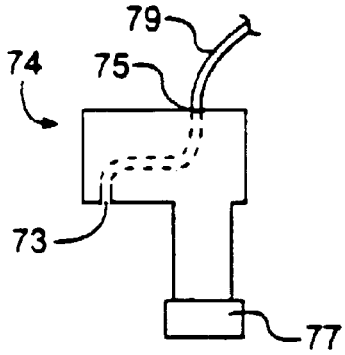
FIG. 8 is a side view of one embodiment of a cap carrier for a container filling system of the present invention.

As can also be seen in FIG. 8, each cap carrier 74 further includes a cap receptacle 73 in fluid communication with a vacuum tube 79, each of which is preferably coupled to each cap carrier 74 at each vacuum opening 75 (see FIG. 6).

Operation of the automated container filler 60 will now be described. While multiple steps of a container filling process may occur simultaneously at any of the plurality of container handling mechanisms 70, the process will, for clarity, be discussed with respect to a single container handling mechanism 70 as it moves through the illustrated carousel positions A, B, C, D, and E. Referring again to FIG. 6, position A represents a container loading position. In this position, the cap carrier 74 is, by operation of the cam disc 80 on the cam bearing 77, in a position in the carrier channel 78 that leaves it clear of the container receptacle 72. This allows the container receptacle 72 of the container handling mechanism to be provided, from an empty container hopper 90, with a container (not shown) to be filled. Loading of the container will be further discussed below. In one embodiment, the container to be filled is a capsule commonly used for medicament delivery.

As the carousel 62 rotates, the container handling mechanism 70 being discussed rotates to position B, which is a container separating position. Position B is optional, but is preferred in embodiments in which the containers to be filled have caps. As the carousel rotates to position B, the cap carrier 74 slides into position over the container block 71 such that the cap receptacle 73 (see FIG. 8) is disposed above the container receptacle 72. Under the power of a vacuum applied via the vacuum tube 79, the cap of the container to be filled is lifted into the cap receptacle 73 where it is held temporarily. The cap may be held by continued application of the vacuum or by other means as desired.

As the carousel 62 continues to rotate, the cap carrier 74 slides in a direction away from the container block 71 to return to a position leaving it clear of the container receptacle 72. This allows for filling of the container in the container filling position C. Adjacent the carousel 62 at position C is a dosing portion 100 having a dosing hole 102 and a dosing plate 104. In a manner analogous to that discussed above with respect to manually operated embodiments, the dosing hole 102 of the dosing plate 104 is filled with a material, such as a powder, to be supplied from a powder hopper 106 to the container to be filled. Once the dose has been formed in the dosing hole 102, the dosing plate 104 will slide to position the dosing hole 102 above the container receptacle 72, and thus above the container to be filled. A sliding position of the dosing plate 104 is preferably controlled by an air piston, but may alternatively be controlled by any suitable means. The dose may then be deposited into the container in any desired manner, numerous of which have been discussed above.

The container having been filled, the carousel 62 rotates to place the container handling mechanism 70 into position D, a container closing position. As illustrated, the cap receptacle 73 of the cap carrier 74 is again positioned above the container receptacle 72 of the container block 71. The cap will then be released from the cap receptacle 73 such that the cap is returned to the container. Additional mechanisms may assist in properly mating the cap with the container if desired.

The carousel 62 will next rotate the container handling mechanism 70 to a container ejecting position E. Here, the filled and capped container is ejected into a full container bin 110.

Figure 9:
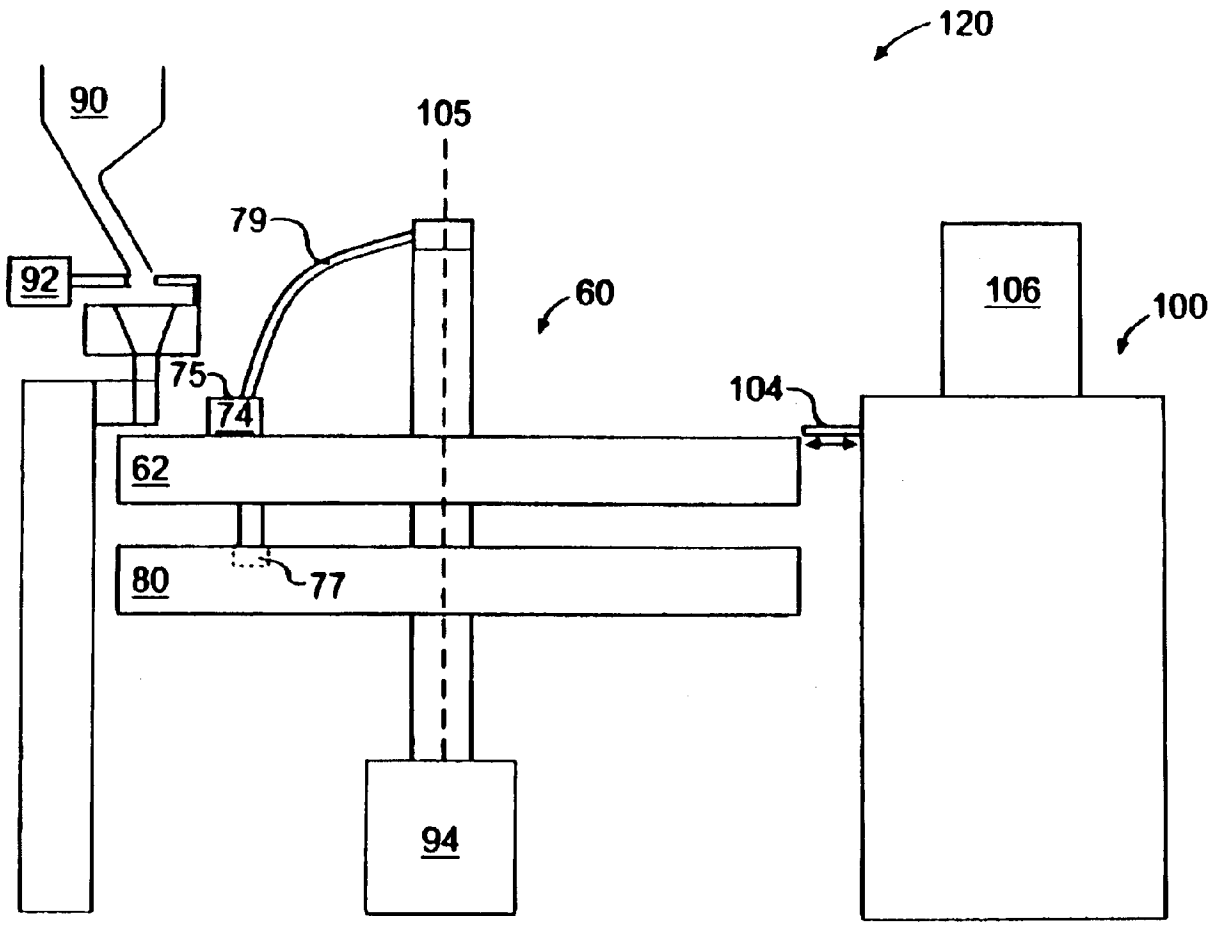
FIG. 9 is a side view of one embodiment of a container filling system of the present invention.

FIG. 9 illustrates an orientation of the empty container hopper 90 and the dosing portion 100 with respect to the container filler 60 in one embodiment of the present invention. As shown, the container filler system 120 may also include a container rectifier 92 for ensuring that containers from the empty container hopper 90 enter each container receptacle 72 in a proper orientation. Also illustrated is a motor 94 for controlling a rotation of the carousel 62. Preferably, the motor 94 is a stepper motor, and is operated under the control of a programmable logic controller (PLC). The PLC further preferably coordinates rotation of the carousel 62 with insertion of empty containers from the empty container hopper 90, operation of the dosing portion 100, and ejection of full containers into the full container bin 110.

EXAMPLE

Table 1 below is provided to further illustrate the present invention, but is not intended to limit the invention in any manner. Table 1 shows results from a series of trials using a system, method and apparatus of the present invention. The first row represents a powder used. The final two rows respectively represent a mass median aerodynamic diameter (MMAD) and mass median geometric diameter (MMGD) for each powder. As can be seen, the first four columns of data reflect results obtained for a single type of powder a. Dosing of powder a was performed at each of four different dosing densities obtained by varying a strength of a vacuum used. Relative standard deviations (RSD) of a mean dose of an indicated sample size from a target fill weight are shown for each trial series. Thus, as can be seen, low RSDs may be obtained through practice of the present invention even for very low MMAD powders.

TABLE 1

| | Powder | | | | | | |
|---|---|---|---|---|---|---|---|
| | a | a | a | a | b | c | d |
| Target Fill Wt. (mg) | 3 | 3 | 22 | N/A[1] | 10 | 5 | 5 |
| Population Size | 1170 | 1170 | 290 | 30 | 200 | 12 | 12 |
| Sample Size | 60 | 36 | 15 | 30 | 14 | 6 | 6 |
| Mean Dose (mg) | 2.7 | 3.1 | 21.3 | 3.7 | 10.3 | 5.0 | 5.0 |
| Plate # | 1 | 1 | 1- | 0 | 7 | 5 | 5 |
| Plate Volume (cc) | 0.015 | 0.015 | 0.130 | 0.015 | 0.090 | 0.060 | 0.060 |
| Dosing Density (g/cc) | 0.18 | 0.20 | 0.16 | 0.25 | 0.11 | 0.08 | 0.08 |
| RSD (%) | 6.1 | 4.9 | 4.6 | 4.3 | 4.1 | 3.7 | 7.8 |
| MMAD | 3.1 | 3.1 | 3.1 | 3.1 | N/A[1] | 2.5 | 2.3 |
| MMGD | 6.7 | 6.7 | 6.7 | 6.7 | N/A[1] | 13.1 | 6.4 |

[1]N/A - data not available.

Conclusion

While various embodiments of the present invention have been described above, it should be understood that they have been presented by way of example only, and not limitation. For example, the present invention is not limited to the physical arrangements or dimensions illustrated or described. Nor is the present invention limited to any particular design or materials of construction, or to any particular types of powder or powder containers. As such, the breadth and scope of the present invention should not be limited to any of the above-described exemplary embodiments, but should be defined only in accordance with the following claims and their equivalents.

What is claimed is:

1. An apparatus for filling containers with powder, comprising:

a dosing plate defining a dosing hole, said dosing plate movable from a first position to a second position;

an ejector member; and wherein when said dosing plate is in said first position, said dosing hole is positioned to directly receive a metered dose of powder, and when said dosing plate is in said second position, said dosing hole is positioned so that actuation of said ejector member ejects the metered dose of powder.

2. The apparatus of claim 1, wherein said dosing plate defines a single dosing hole.

3. The apparatus of claim 1, further comprising:

a dosing wheel defining a container receptacle, wherein said dosing wheel is configured with a round shape.

4. The apparatus of claim 1, further comprising:

a dosing wheel defining a container receptacle, wherein said dosing wheel is configured with a straight shape.

5. The apparatus of claim 1, further comprising:

a dosing wheel defining a container receptacle, wherein said dosing wheel is configured to linearly movably communicate with said dosing plate.

6. The apparatus of claim 1, further comprising:

a dosing wheel defining a container receptacle, wherein said dosing wheel is configured to movably communicate with said dosing plate.

7. The apparatus of claim 6, wherein said container receptacle is movable from a first container receptacle position to a second container receptacle position, such that in said second container receptacle position, said dosing plate is in said second position so that said container receptacle is in registry with said dosing hole.

8. The apparatus of claim 6, wherein said dosing wheel is movable from a first dosing wheel position to a second dosing wheel position, wherein when said dosing wheel is in said second dosing wheel position said container receptacle is in registry with said dosing hole.

9. The apparatus of claim 5, wherein said dosing wheel is movable from a first dosing wheel position to a second dosing wheel position, wherein when said dosing wheel is in said second dosing wheel position said container receptacle is in registry with said dosing hole.

10. The apparatus of claim 5, wherein said container receptacle is movable from a first container receptacle position to a second container receptacle position, such that in said second container receptacle position, said dosing plate is in said second position so that said container receptacle is in registry with said dosing hole.

11. The apparatus of claim 5, further comprising a container disposed in said container receptacle.

12. The apparatus of claim 11, wherein said container is a gelatin capsule.

13. The apparatus of claim 11, wherein said container is a hydroxypropylmethyl cellulose capsule.

14. The apparatus of claim 6, further comprising a container disposed in said container receptacle.

15. The apparatus of claim 14, wherein said container is a gelatin capsule.

16. The apparatus of claim 14, wherein said container is a hydroxypropylmethyl cellulose capsule.

17. The apparatus of claim 1, further comprising a powder hopper, wherein said powder hopper is configured to dispense powder into said dosing hole.

* * * * *